US006626639B2

(12) United States Patent
Schofield

(10) Patent No.: US 6,626,639 B2
(45) Date of Patent: Sep. 30, 2003

(54) VACUUM PUMP

(75) Inventor: Nigel Paul Schofield, Horsham (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/872,930

(22) Filed: Jun. 1, 2001

(65) Prior Publication Data

US 2002/0018712 A1 Feb. 14, 2002

(30) Foreign Application Priority Data

Jun. 2, 2000 (GB) ..... 0013491

(51) Int. Cl.[7] ..... F04D 19/04

(52) U.S. Cl. ..... 415/90; 415/121.2; 415/143; 415/169.1; 415/55.5; 415/55.6; 415/55.7

(58) Field of Search ..... 415/90, 143, 121.2, 415/169.1, 55.1, 55.5, 55.6, 55.7; 417/423.4

(56) References Cited

U.S. PATENT DOCUMENTS 4,323,369 A 4/1982 Monson et al.
4,808,067 A 2/1989 Saulgeot
5,709,528 A 1/1998 Hablanian
5,921,746 A * 7/1999 Yu et al. ..... 415/55.1
6,135,709 A * 10/2000 Stones ..... 415/90

FOREIGN PATENT DOCUMENTS

EP 0 129 709 A2 1/1985
EP 0 805 275 A2 11/1997
EP 0 805 275 A3 7/1998

OTHER PUBLICATIONS

European Search Report completed Nov. 29, 2002 of Application No. EP 01 30 4799.

* cited by examiner

*Primary Examiner*—Christopher Verdier
(74) *Attorney, Agent, or Firm*—Joshua L. Cohen; Ira Lee Zebrak; Salvatore P. Pace

(57) ABSTRACT

A compound vacuum pump includes a regenerative section and a Holweck section. An annular abutment is formed on the radially innermost rotating cylinder of the Holweck section. The abutment acts to cause dust and foreign particles entering an inlet of the pump to be trapped before entering an inlet of the regenerative section. A circular barrier may be used with the abutment to assist with trapping the dust and foreign particles.

12 Claims, 1 Drawing Sheet

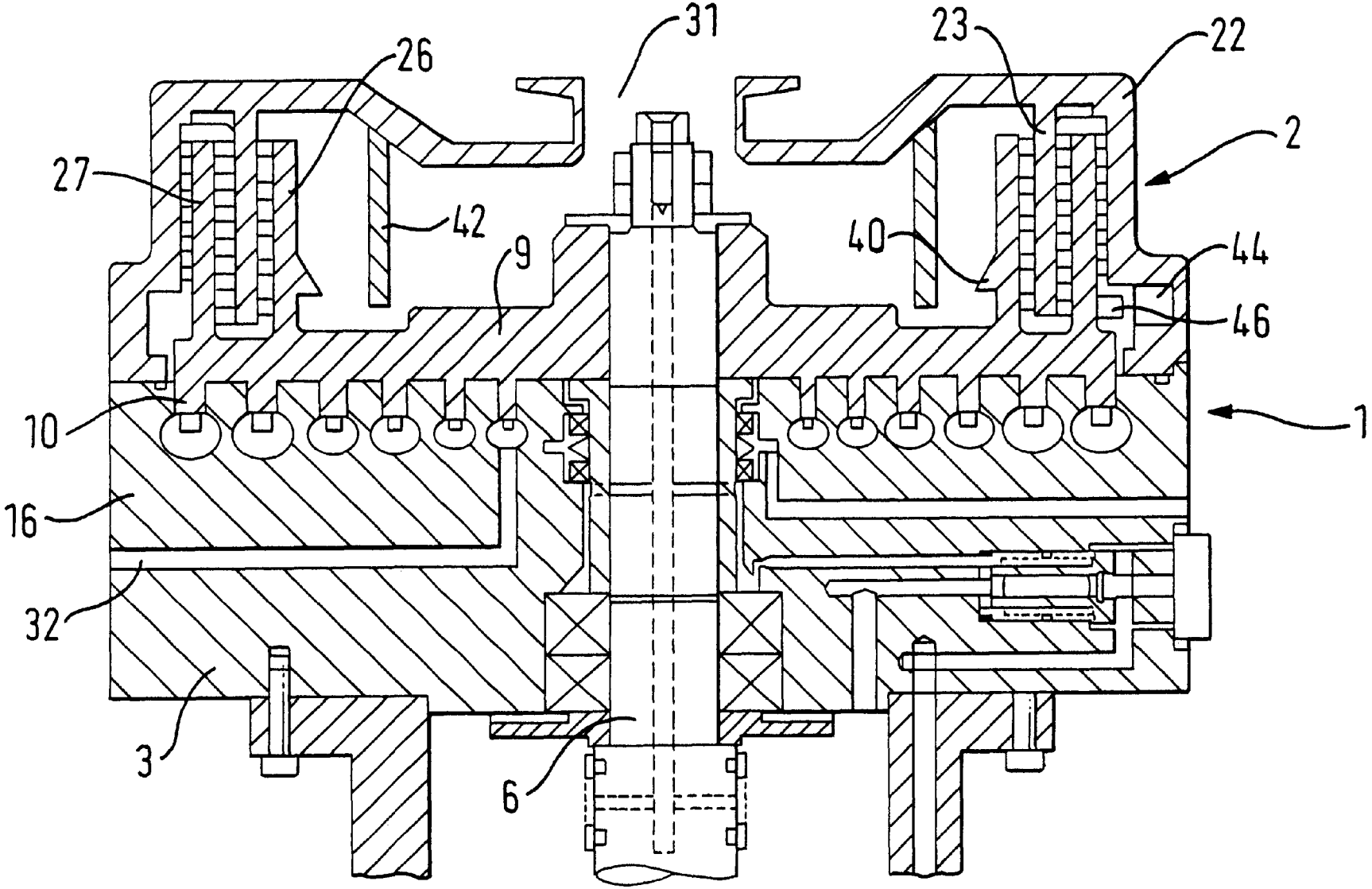
1
2
22
44
46
23
40
31
9
42
26
27
10
16
32
3
6

VACUUM PUMP

BACKGROUND OF THE INVENTION

The present invention relates to vacuum pumps and in particular, "hybrid" or compound vacuum pumps which have two or more sections with different operational modes for improving the operating range of pressures and throughput of the pumps.

In European patent application number 97302890 (EP 0 805 275 A2), there is described a compound vacuum pump having a regenerative section and a Holweck section.

A disadvantage of vacuum pumps, which consist of or include a regenerative section, is that the regenerative section is sensitive to dust and other foreign bodies. Dust and other foreign bodies have been known to cause blade breakage and erosion or occlusion within the fine running tolerances associated with regenerative sections.

OBJECT AND SUMMARY OF THE INVENTION

It is an object of the present invention to provide a compound vacuum pump having Holweck and regenerative sections, and including a trap for preventing or inhibiting dust and other foreign bodies from reaching the inlet of the regenerative section.

According to the present invention, there is provided a compound vacuum pump consisting of a Holweck section upstream of a regenerative section, and means associated with the Holweck section for separating and trapping dust and other foreign bodies within the Holweck section.

In one embodiment, the Holweck section includes alternate stationary and rotating cylinders, the stationary cylinders being mounted on a stator and the rotating cylinders being mounted for rotary movement with a rotor; and separating and trapping means including an annular abutment formed on the radially innermost rotating cylinder.

In a further embodiment, the Holweck section includes alternate stationary and rotating cylinders, the stationary cylinders being mounted on a stator and the rotating cylinders being mounted for rotary movement with a rotor; and separating and trapping means being located between the last stage of the Holweck section and the inlet stage of the regenerative section, the separating and trapping means including a cavity formed in the Holweck stator and immediately opposite said cavity a blade fixed for rotary movement extending radially outwardly from the outermost rotating cylinder.

BRIEF DESCRIPTION OF THE DRAWING

An embodiment of the invention will now be described by way of example, reference being made to the FIGURE of the accompanying diagrammatic drawing which is a cross section through a compound vacuum pump having the present invention used with a Holweck section and a regenerative section of the pump.

DETAILED DESCRIPTION OF THE PREFERRED EMBODIMENTS

As shown, a compound vacuum pump includes a regenerative section 1 and a Holweck section 2. The pump includes a housing 3 made from a plurality of different body parts bolted or otherwise fixed together and provided with relevant seals therebetween in a manner known per se.

Mounted within the housing 3 is a shaft 6 supported by bearings, the shaft being rotatable about its longitudinal axis and driven by an electric motor surrounding the shaft 6.

Securely attached to the shaft 6 for rotation therewith is a rotor 9 which overlies a body portion 16 of the housing 3. Attached to the body portion 16 by means of bolts (not shown) is a body portion 22 which forms the stator of the Holweck section 2. The body portion 22 includes a central inlet 31 for the Holweck section 2. Depending from the body portion 22 is a hollow annular cylinder 23 whose longitudinal axis is parallel to the longitudinal axis of the shaft 6 and the rotor 9.

A set of two concentric hollow cylinders 26, 27 whose longitudinal axes are also parallel to the longitudinal axis of the shaft 6 and the rotor 9 are securely fixed at their lower (as shown) ends to the upper surface of the rotor 9.

Each of the cylinders 23, 26, 27 is mounted symmetrically about the main axis, that is, the longitudinal axis of the shaft 6 and, as shown, the cylinders are interleaved thereby to form a uniform gap between each adjacent cylinder. This gap, however, reduces from the innermost adjacent cylinder 26 to the outermost adjacent cylinder 27.

Situated in the gap between each adjacent cylinder is a threaded flange (or flanges) which define a helical structure extending substantially across the gap. This flange can be attached at either of the adjacent cylinders in a manner known per se.

As shown, the rotor 9 is in the form of a disc, the lower (as shown) surface of which has formed thereon a plurality of raised rings 10, which, as is known in the art, form part of the regenerative section 1, and form no part of this invention.

According to the present invention, means associated with the Holweck section 2 is provided for separating and trapping dust and other foreign bodies within the Holweck section 2 before the dust or other foreign bodies can reach the inlet section of the regenerative section 1.

As shown, the radially innermost rotating cylinder 26 has formed on its inner surface an annular abutment 40. The abutment 40 acts to cause any dust and foreign particles entering the inlet 31 and the recess inside the Holweck stages to be trapped by the abutment 40 as the flow of the gases passes up the inner surface of the vane 26.

As shown, in order to assist in the trapping process, it is preferable to have a circular barrier 42 depending from body portion 22 in a direction towards the upper (as shown) surface of the rotor 9.

In use, with the shaft 6 and rotor 9 spinning at high speed, gas with any dust or foreign bodies therein is drawn into the inlet 31 within the body portion 22 and the stages of the Holweck section 2 where it is spun and any dust or foreign bodies trapped by the abutment 40. The remaining clean gas then passes into the gap between adjacent cylinders 26, 23 and passes down the helix formed by the upstanding flange in the cylinder 26, and then up the gap between the cylinders 23 and 27 and so on, until it passes down the gap between cylinder 27 and the wall of the body portion 22. The clean gas then passes through porting (not shown) in a manner known into the inlet of the regenerative section 1 and hence out to the atmosphere via an outlet 32.

In addition to or as a substitute for the abutment 40 and the barrier 42 a centrifugal dust trap is shown downstream of the Holweck stages but before the inlet stage of the regenerative section 1. The centrifugal dust trap consists of a cavity 44 formed in the body portion 22 and a radially extending blade 46 mounted for rotational movement on the cylinder 27 for rotation therewith. Thus, when gas having any dust or foreign bodies leaves the outermost (last) Holweck stage, it will be forced by centrifugal force into the cavity 44. This has a particular advantage in that the trapped dust is held further from the pump inlet 31 which minimizes the risk of trapped dust being blown back into the pumping lines and process chamber during a pump shutdown.

The centrifugal dust trap 44, 46 may be used on its own or together with the abutment 40 to minimise the risk of any dust reaching the inlet stage of the regenerative section 1.

Although in the Holweck section 2 described above only one stator cylinder 23 is shown interleaved with two rotating cylinders 26, 27, clearly any practical number of stator and rotating cylinders can be used.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A compound vacuum pump comprising:

a Holweck section upstream of a regenerative section and comprising alternate stationary and rotating cylinders, the stationary cylinder being mounted on a stator and the rotating cylinders being mounted for rotary movement with a rotor; and separating and trapping means associated with the Holweck section for separating and trapping dust and other foreign bodies within the Holweck section which includes an annular abutment formed on the radially innermost rotating cylinder.

2. The compound vacuum pump according to claim 1, wherein the separating and trapping means further comprises:

a barrier depending from the stator towards the rotor and spaced from the rotor.

3. The compound vacuum pump according to claim 2, wherein the means for separating and trapping further comprises:

a centrifugal dust trap located between a last stage of the Holweck section and an inlet stage of the regenerative section.

4. The compound pump according to claim 3, wherein the centrifugal dust trap comprises:

a cavity formed in a stator wall of the Holweck section; and a radial blade extending from an outermost rotating cylinder of the Holweck section for coaction with the cavity.

5. The compound vacuum pump according to claim 1, wherein the means for separating and trapping further comprises:

a centrifugal dust trap located between a last stage of the Holweck section and an inlet stage of the regenerative section.

6. The compound vacuum pump according to claim 5, wherein the centrifugal dust trap comprises:

a cavity formed in a stator wall of the Holweck section; and a radial blade extending from an outermost rotating cylinder of the Holweck section for coaction with the cavity.

7. The compound vacuum pump according to claim 1, wherein the separating and trapping means further comprises:

a cavity formed in a stator wall of the Holweck section; and a radial blade extending from an outermost rotating cylinder of the Holweck section for coaction with the cavity.

8. A compound vacuum pump comprising:

a first pump section;

a second pump section arranged for coaction with the first pump section and disposed downstream of said first pump section;

first retaining means disposed in said first pump section for retaining dust and other particulate matter in said first pump section comprising an abutment extending within said first pump section for rotary movement with respect to said first pump section.

9. The pump according to claim 3, wherein the abutment is annular-shaped.

10. The pump according to claim 8, wherein said first retaining means further comprises:

a barrier extending in said first pump section toward said second pump section and spaced from said abutment and said second pump section for coaction with said abutment.

11. The pump according to claim 8, further comprising second retaining means disposed between said first and second pump sections for retaining dust and other particulate matter in said first pump section and having a cavity constructed and arranged in a wall of the first pump section and a blade extending in said first pump section for rotation therein and coaction with said cavity.

12. The pump according to claim 11, wherein said blade is radially shaped with respect to said first section and disposed in registration with said cavity.

* * * * *